United States Patent [19]

Lok

[11] Patent Number: 4,803,782

[45] Date of Patent: Feb. 14, 1989

[54] LETTER OPENER

[76] Inventor: Hin C. Lok, 10454 Neal Dr., Westminster, Calif. 92683

[21] Appl. No.: 124,267

[22] Filed: Nov. 23, 1987

[51] Int. Cl.[4] ..... B26B 29/00

[52] U.S. Cl. ..... 30/294; 30/162; 30/283; 30/DIG. 3

[58] Field of Search ..... 30/DIG. 3, 280, 283, 30/294, 162

[56] References Cited

U.S. PATENT DOCUMENTS

| | | | |
|---|---|---|---|
| 2,247,840 | 7/1941 | Harrison | 30/DIG. 3 X |
| 2,282,062 | 5/1942 | Jewett | 30/DIG. 3 X |
| 2,672,933 | 3/1954 | Bridy | 30/DIG. 3 X |
| 2,679,100 | 5/1954 | Ehler | 30/294 X |
| 3,137,070 | 6/1964 | Geier et al. | 30/DIG. 3 X |
| 3,619,902 | 11/1971 | Fleury | 30/294 |

*Primary Examiner*—Frank T. Yost
*Assistant Examiner*—Rinaldi Rada
*Attorney, Agent, or Firm*—Charles H. Thomas

[57] ABSTRACT

An implement is provided for opening letter envelopes comprised of a body defining a handle and an envelope receiving crevice of a predetermined width and length. A blade is disposed within the body and has a cutting edge directed toward the crevice. A guide within the body limits movement of the blade to a linear path between a position wherein the cutting edge projects into the crevice in the direction of the width thereof and a position wherein the cutting edge is withdrawn from the crevice. Guides within the body control the position of the blade along the path and a manually operable slide is provided for external actuation. A dial is eccentrically mounted on the body in the path of movement of the slide and is rotatable to adjustably limit the extent of projection of the cutting edge of the blade into the crevice. The dial prevents the blade from spanning the crevice entirely.

6 Claims, 1 Drawing Sheet

LETTER OPENER

BACKGROUND OF THE INVENTION

1. Field of the Invention

The present invention relates to an improved implement for opening letter envelopes.

2. Description of the Prior Art

Conventional letter openers or letter envelope openers are elongated devices constructed with handles that terminate in narrow blades. To use a conventional letter opener, the tip of the blade is inserted into a small gap formed at an edge of the envelope where the envelope flap is folded over and sealed to the body of the envelope. The envelope is then held immobile and the blade is pulled along the length of the flap at the fold therein while tension is exerted between the fold of the flap and the body of the envelope. The blade thereby severs the envelope flap at the fold therein so that the contents of the envelope may be withdrawn through the opening formed at the severed flap.

Conventional envelope opening devices are inadequate for several reasons. Not infrequently the blade of a conventional letter opening device will engage not only the fold of the flap of the envelope, but also folded papers within the envelope. When this occurs the cutting action of the blade severs not only the envelope, but also papers within the envelope.

The process of opening an envelope with a conventional letter envelope opener is also relatively slow. The user must first locate an opening adjacent to a strip of adhesive on the envelope flap, insert the tip of the letter opener into that opening, and then run the letter opener along the length of the fold of the flap. In this process the time required to locate the opening and insert the tip of the letter opener into the opening constitutes a substantial portion of the total time required to open the envelope. While the total time required to open a single envelope is minimal, the labor cost in opening a multitude of envelopes in large mailrooms with conventional letter openers is very substantial. Furthermore, the time required for opening mail is further lengthened when the letter opener engages papers within the envelope, in the manner previously described, and also when the letter opener snags on a paper clip or staple within the envelope. The delay in disengaging the letter opener from a paper clip or staple is not insignificant when a large number of envelopes are to be opened, and such delays recur a number of times.

Further delays in opening mail are frequently encountered when the envelope construction is such that a gap at the fold of the flap cannot be located. Most envelopes are constructed in a manner such that the strips of moisture sensitive adhesive do not extend entirely to the area of the fold. However, this is not true of all envelopes. In some envelopes the adhesive strips do extend entirely along both edges of the envelope flap, so that a gap at the fold within which to insert the envelope opener does not exist. This difficulty is also encountered when the flaps of envelopes are sealed with tape. The only solution when such a difficulty arises is to manually tear the envelope so as to create an opening for insertion of the letter opener blade. The contents of the envelope may also be torn when this proves necessary, and in any event a delay is occasioned.

SUMMARY OF THE INVENTION

The present invention is directed to an improved envelope opening implement which may be used to open letter envelopes far more quickly than is possible with conventional envelope openers. Unlike conventional envelope openers, the implement of the invention does not require the presence of an opening at which a tear is to be initiated. To the contrary, the envelope opening implement of the invention initiates a cut along one edge of the envelope by penetration from without, rather than by an initial insertion into an opening and tearing from within. Consequently, time is not lost in searching for an appropriate opening at the edge of the flap of the envelope so as to initiate a tearing action.

A further advantage of the invention is that the contents of an envelope cannot be damaged utilizing the envelope opening implement of the invention. It is not necessary to insert a blade deep into the interior of an envelope where it is likely to engage the contents of the envelope using the envelope opening implement of the invention. To the contrary, the blade of the implement of the invention is directed through the structure of the envelope only along a very narrow margin extremely close to an edge of the envelope.

The device of the invention employs a body having an envelope receiving slot, channel or crevice of a predetermined width and depth. Both the width and depth of the slot are quite small. Once the edge of the envelope is inserted into the slot, the blade of the envelope opening implement is directed laterally into the slot, but not entirely across the width of the slot. Consequently, once the envelope is pulled through the slot the blade slices through the structure of at least one side of the envelope, but without totally impaling and immobilizing the envelope within the slot.

In one broad aspect the present invention is a device for opening an envelope comprising a body defining an envelope receiving slot of a predetermined width and length, a blade having a cutting edge and reciprocally mounted within the body so that the cutting edge is movable to project into the slot in the direction of the width thereof, and means mounted on the body for adjustably limiting the extent to which the cutting edge projects into the slot and for preventing the cutting edge from extending across the entire width of the slot. The width of the slot is preferably no greater than about 0.5 centimeters and the depth of the slot beneath the blade is preferably even less. The slot defined in the body is preferably of a U-shaped or channel-shaped configuration and the distance from the blade to the floor of the channel is preferably no greater than two millimeters.

To open an envelope the device of the invention is preferably held with the channel-shaped slot inverted over the top edge of the envelope. This allows the contents of the envelope to drop toward the opposite, lower edge, and away from the upper edge. When the upper edge of the envelope is inserted into the slot and then drawn through it, the longitudinally projecting blade presses against the structure of the envelope a distance of only about two millimeters or less from the upper edge of the envelope. The chances of the contents of an envelope being damaged are thus extremely minimal.

The blade employed in the letter opening device of the invention is preferably a razor-type blade normally shaped in a parallelogram configuration with cutting edges on opposite ends. The cutting edges of the blade are inclined at an angle relative to the length of the blade and the blade is removably and reversibly mounted on a slide within the body. The blade can be reversed so that the cutting edge may alternatively be inclined toward either of the opposite ends of the transverse channel. Thus, the letter opening device of the invention can be easily converted for either right-hand or left-hand use. Also, when one cutting edge of the blade becomes dull, the blade is simply turned one hundred eighty degrees within the body of the implement, thereby orienting the opposite cutting edge in a position for use.

Only the very extreme tip of the razor blade extends into the channel approximately midway along the total depth of the channel. The channel is preferably no greater than 0.5 centimeters in width so that a user cannot inadvertently insert a fingertip into the channel where it might be injured by the razor blade. Although the cutting edge is quite sharp, it is never exposed as is the case with a conventional letter opener. Consequently, it is much safer than a conventional opener.

The means for adjustably limiting the extent to which the cutting edge projects into the slot preferably may include a circular dial which is eccentrically mounted on the body in the path of a slide mechanism. The slide mechanism is used to push the blade toward the slot so that the cutting edge projects into the slot. The dial forms an abutment which limits the longitudinal movement of the slide. By selectively rotating the dial about its eccentric axis, the longitudinal limit of movement of the slide can be altered thereby altering the extent to which the tip of the cutting edge of the blade projects into the slot. The dial is configured so that even when the slide is permitted to move a maximum length along its path of travel, the tip of the cutting edge will not extend entirely across the width of the slot. The slide is preferably spring biased rearwardly so that the blade remains drawn entirely into the body of the implement until the actuating element of the slide on the surface of the body is manually pressed forward.

The invention may be described with greater clarity and particularity by reference to the accompanying drawings.

DESCRIPTION OF THE EMBODIMENTS

Figure 1:
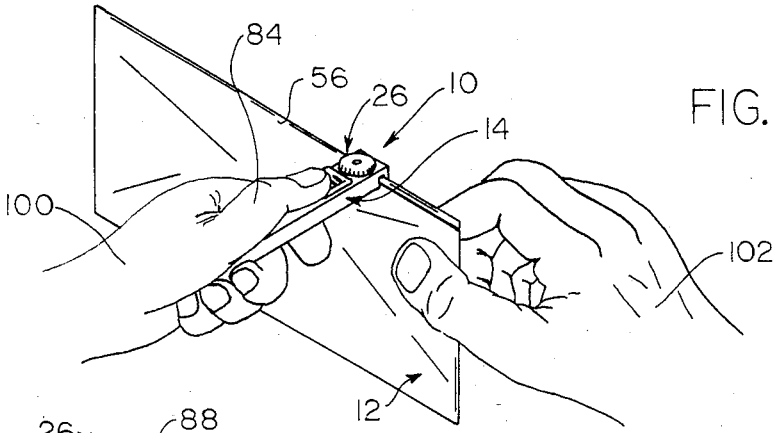
FIG. 1 is a perspective view illustrating the manner of use of a preferred embodiment of an envelope opening implement according to the invention.
Figure 2:
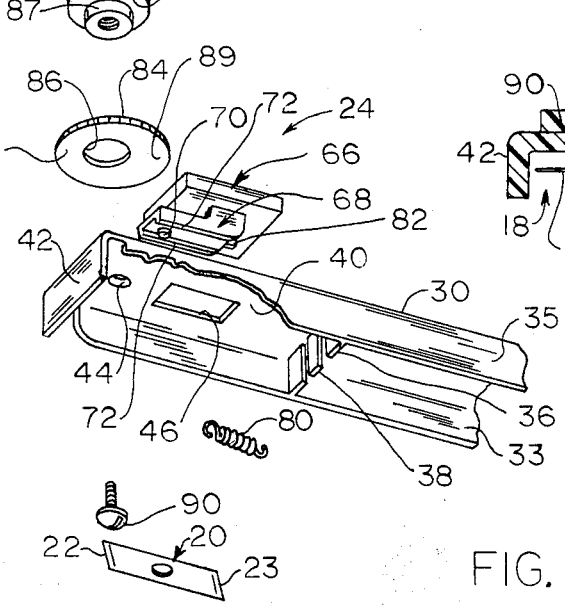
FIG. 2 is an exploded perspective view of a portion of the implement of FIG. 1.
Figure 3:
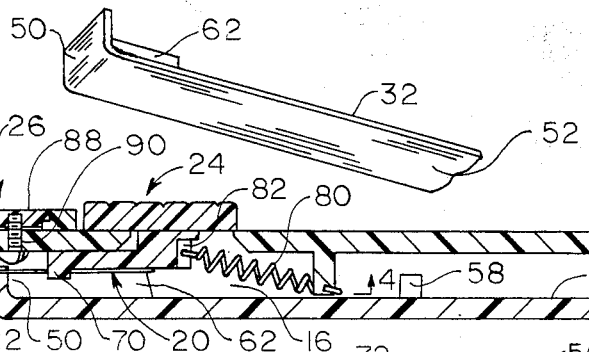
FIG. 3 is a side elevational sectional view of the implement of FIG. 1.

FIG. 1 illustrates the manner of use of an implement 10 constructed in accordance with the invention for opening envelopes, such as the envelope 12. The device 10 is comprised of a body 14 defining a cavity 16 therewithin and forming a transverse channel or slot 18 of a predetermined width, as depicted in FIG. 3. A parallelogram-shaped razor blade 20 is disposed within the cavity 16 and has cutting edges 22 and 23. The cutting edge 22 is directed toward the transverse channel 18. An externally actuatable means in the form of a slide assembly 24 is provided for moving the blade 20 in longitudinally reciprocal fashion between a retracted position entirely within the cavity 16 and an extended position in which the cutting edge 22 projects longitudinally into the channel 18, as depicted in FIG. 3. An adjustable blade movement control means in the form of a dial assembly 26 limits the extent to which the cutting edge 22 projects into the channel 18 to a predetermined distance which is less than the entire width of the channel 18.

The body 14 is an elongated structure which defines a handle 28 which may be gripped in the palm of a user's hand 100. The body 14 is formed of separable mating elements 30 and 32 which are releasably securable together to define the cavity 16 therebetween. The body portion 30 is an elongated, tunnel-shaped structure formed of injected molded plastic and having a roof 40, side walls 33 and 35, and stiffening partitions 34 and 36 which extend transversely between the walls 33 and 35. The stiffening partition 36 is divided by two discontinuities near its center to form a central anchoring post 38 which depends from the roof 40 of the portion 30 is turned downwardly in an overhanging lip 42 which forms one wall of the channel or slot 18. A small circular opening 44 is defined in the roof 40 near the lip 42 and a larger, longitudinally elongated rectangular opening 46 is defined in the roof 40 between the circular opening 44 and the transverse partition 36.

The body portion 32 is an elongated, slab-like structure which is turned upwardly at its opposite ends to define lips 48 and 50 which rise from a base 52. The exterior surfaces of the lips 48 and 50 are rounded convexly outwardly at the opposite ends of the body portion 32. The rounded transition between the lip 50 and the base 52 aids in guiding the top edge 56 of the envelope 12 into the channel or slot 18.

The body portion 32 includes a plurality of pairs of fastening posts 58 which rise from the interior surface of the base 52 just within the lateral margins of the longitudinal edges 60 of the base 52. The marginal distance between the fastening posts 58 and the longitudinal edges 60 of the base 52 are just sufficient to receive the wall thicknesses of the downwardly projecting side walls 33 and 35 of the top portion 30 of the body 14. The fastening posts 58 press laterally outwardly against the side walls 33 and 35 to hold the body portions 30 and 32 together by means of frictional engagement. That is, the fastening posts 58 are frictionally engaged with the side walls 33 and 35.

At the front end of the body portion 32 a pair of interior laterally spaced, longitudinal, mutually parallel tracks 62 extend rearwardly from the lip 50 and are spaced inwardly from the edges 60. The tracks 62 support the blade 20 from beneath.

The slide assembly 24 is an injection molded structure which includes an external manually actuable generally rectangular shaped element 66 and an internal element 68 depending from the underside of the external element 66. The external element 66 slides along the top outer surface of the roof 40 of the body portion 14. The internal element 68 is of a generally L-shaped overall configuration and projects downwardly through the rectangular opening 46 in the body roof 40. Beneath the roof 40 the internal element 68 defines a downwardly directed generally circular blade engaging post 70 near its forward end. The internal element 68 is also provided with a pair of parallel, longitudinally oriented downwardly depending rails 72 which are located equidistant from the blade engaging post 70 and which are oriented in the direction of longitudinal reciprocation of the slide assembly 24. The rails 72 embrace and laterally constrain the side edges of the blade 20 and likewise embrace and bracket the parallel tracks 62 on the body member 32. The blade engaging post 70 extends through the opening 74 in the blade 20 to secure the blade 20 relative to the slide assembly 24. The tracks 62 laterally constrain and guide the rails 72 in longitudinally reciprocal movement and support the blade 20 from beneath as the internal element 68 longitudinally traverses the length of the rectangular opening 46. The tracks 62 thereby serve as a guide means within the cavity 16 to slidably engage the internal slide element 68 of the slide assembly 24 and to limit movement of the slide assembly 24 to longitudinal reciprocation.

Figure 4:
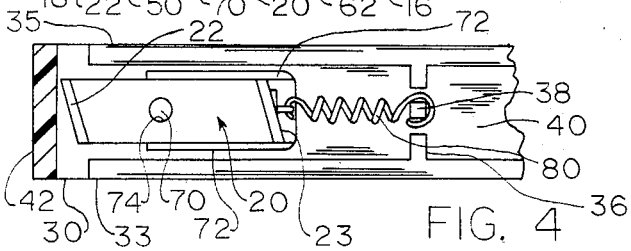
FIG. 4 is a sectional plan detail taken along the lines 4—4 of FIG. 3.
Figure 5:
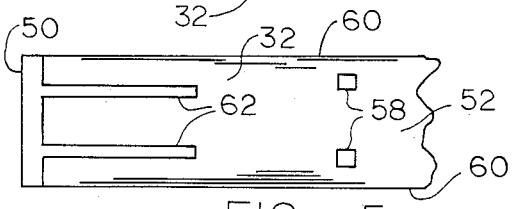
FIG. 5 is an isolated plan view of a portion of the body of the device depicted in FIG. 3.

As best illustrated in FIG. 4, the blade 20 has cutting edges 22 and 23 at its opposite ends. A circular aperture 74 of the blade 20 is located in the exact center of the blade so that either cutting edge 22 or 23 may be positioned to project forwardly toward the slot 18 the same distance relative to the slide assembly 24. In FIG. 4 the cutting edge 22 is oriented to project toward the slot 18. Should the cutting edge 22 become dull, however, the body portions 30 and 32 are merely pulled apart to expose the blade 20. The blade 20 is then lifted to disengage the blade engaging post 70 from the aperture 74 and is then turned one hundred eighty degrees in the same plane. The blade engaging post 70 is then re-engaged in the aperture 74 with the positions of the cutting edges 22 and 23 reversed.

Also, the device 10 may be easily converted for either right-handed or left-handed use by merely lifting the blade 20 from the blade engaging post 70, rotating it one hundred eighty degrees about its longitudinal axis, and re-engaging the blade engaging post 70 in the aperture 74. As illustrated in FIG. 4, the cutting edge 2 is oriented at an acute angle relative to the transverse channel 18, and extends up and to the left in the view of FIG. 4. When the implement is converted for use with a different hand, the position of the blade 20 is reversed so that the cutting edge 22 will extend up and to the right at the same acute angle. Thus, the angle of orientation of the cutting edge 22 relative to the channel 18 is likewise reversible.

The letter opening device 10 is provided with a coil return spring 80 which has hooks at opposite ends for securement to the implement body 14 and to the internal element 68 of the slide assembly 24. Specifically, one hooked end of the coil spring 80 is engaged in an opening in a longitudinally oriented rearwardly projecting longitudinally centered tang 82 on the internal element 68 of the slide assembly 24. The opposite end of the spring 80 is hooked about the spring anchoring post 38 formed in the transverse partition 36. The spring 80 thereby acts between the body and the internal element 68 to urge the blade 20 away from the slot 18. The slide assembly 24 is thus pulled rearwardly to the rearmost extremity of the rectangular opening 46 by the spring 80 unless manually pressed forward by the thumb 84 of a user in the manner depicted in FIG. 1.

The control means 26 is comprised of a dial 84 having a circular eccentrically located opening 86 defined therethrough. The diameter of the eccentrically located opening 86 is greater on the upper surface of the dial 84 than at the lower surface thereof, so that an annular bearing ledge is defined to seat the annular flange 85 and receive the downwardly depending, interiorally threaded barrel 87 of a T-nut 88. The flange 85 of the T-nut 88 seats upon the bearing ledge and holds the barrel 87 out of contact with the upper surface of the body portion 30. The shank of a machine screw 90 is inserted through the opening 44 in the roof 40 of the body portion 30 and is threadably engaged within the tapped barrel 87 of the T-nut 88. The screw 90 may be tightened sufficiently to hold the dial 84 at a selected position of rotation atop the body element 30 but not so tightly as to prevent purposeful rotation of the dial 84 by the hands of the user.

The dial disk 84 is mounted for adjustable rotation about an eccentric axis oriented perpendicular to the direction of longitudinal reciprocation of the slide assembly 24. The dial 84 may be rotated between a position in which the widest portion 89 of its structure faces the external manually actuable element 66 of the slide assembly 24. When rotated to this disposition, the reciprocal range of the slide assembly 24 is at a minimum, since the structure of the dial 84 limits the forward advance of the manually actuable element 66 to a minimum. The eccentricly mounted dial 84 is located in the path of longitudinal movement of the externally actuable slide assembly 24. Conversely, when the dial 84 is rotated about the axis of the shank of the screw 90 to bring the narrowest portion 91 of the structure of the dial into abutment facing the external slide element 66, the range of longitudinal reciprocation of the internal element 68 of the slide assembly 24 is maximized. Even so, however, the width of the abutting portion 91 of the dial 84 is sufficient to prevent the cutting edge 22 of the blade 20 from reaching the interiorly facing surface of the lip 42.

The width of the slot 18 is no greater than about 0.5 centimeters between the mutually facing surfaces of the lips 42 and 50 of the body portions 30 and 32, respectively. This separation is too small to admit even the tip of a finger of a user which might inadvertently be directed into the slot or channel 18. As a consequence, the cutting edges 22 and 23 of the blade 20 cannot injure the hand of a user. The separation between the blade 20 and the roof 40 is preferably less than 2 millimeters.

In the operation of the implement 10, the user grips the envelope opening device 10 in one hand 100 and at the same time grips an envelope 12 to be opened in the other hand 102. The top edge 56 of the envelope 12 is then inserted into the slot 18 near the fingers of the user's hand 102. The curvature of the lip 50 aids in bringing the top marginal edge 56 of the envelope 12 into seated registration against the roof 40 in the slot 18. The user then rotates the dial disk 84 as desired to control the extent to which the blade 20 can be projected longitudinally into the slot 18 in the direction of the width thereof. The appropriate position of the dial disk 84 will vary among users, since different users are likely to press harder on the external manually actuable element 66 of the slide assembly 24. The user presses the external element 66 toward the lip 42, thereby overcoming the bias of the spring 80 and pressing the cutting edge 22 of the blade 20 into the slot or envelope receiving crevice 18. Within the body cavity 16 the tracks 62 cooperate with the rails 72 to ensure that the blade 20 can move only in longitudinally reciprocal fashion. With the external manually actuable element 66 pressed forwardly, the user in a quick movement runs the letter opening device 10 along the upper edge 56 of the envelope 12 away from the hand 102. The envelope edge 56 is pinched between the cutting edge 22 of the blade 20 and the interiorly facing surface of the body lip 42 as the envelope 12 is pulled through the transverse slot 18. Either one or both sides of the paper of the envelope 12 will be neatly sliced, thus allowing the contents of the envelope 12 to be readily withdrawn. The forwardly projecting cutting edge 22 of the blade 20 will slice an opening in at least the side of the envelope 12 facing the blade 20 along the entire top edge 56. When the user releases the thumb 84 from the external element 66 of the slide assembly 24, the coil spring 80 will pull the blade 20 back into the cavity 16 of the body 14.

The eccentric disk-like dial 84 is designed to stop the manually actuated slide element 66 within a variable distance selected within a predetermined range. With the dial 84 the advanced position of the blade 20 can be closely adjusted to fine tune the precision cutting clearance between the cutting edge 22 of the blade 20 and the facing surface of the lip 42 to compensate for the tolerances and resiliency of the structural components of the device.

No tool is required to change the razor blade 20. To the contrary, the razor blade 20 may be exposed and reversed for either right-handed or left-handed use, or to provide a fresh cutting edge in a matter of a very few seconds by merely snapping the body portions 30 and 32 apart and manually repositioning the blade 20 as desired.

All of the operating mechanisms of the letter opening implement 10 are located at one end of the structure, thus providing enough room at the opposite end of the cavity 16 for inclusion of some other implement, such as a ball point pen or a utility knife. Also, spare blades 20 can be stored in the opposite end of the cavity 16. The device of the invention is extremely simple in construction and is easy to assemble. It has a very low cost of manufacture and requires minimal maintenance. The device 10 is quite small and may be easily carried in the manner of a ball point or fountain pen.

Figure 6:
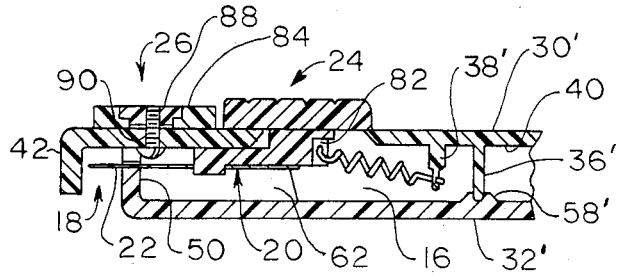
FIG. 6 is a sectional elevational detail illustrating a portion of an alternative embodiment of the invention.

FIG. 6 illustrates an alternative embodiment 10' of a letter opening implement according to the invention. Corresponding parts of the implement 10' are indicated by the same reference numbers as in the implement 10. The primary difference of the implement 10' from the device 10 is that the spring 80 is connected to an anchoring post 38' that extends downwardly from the roof 40 forwardly of the partition 36', ad the body portions 30' and 32' are held together by frictional engagement of the transverse partition 36' within a groove defined in a gripping element 58'.

Undoubtedly, numerous variations and modifications of the invention will become readily apparent to those familiar with letter opening devices. Accordingly, the scope of the invention should not be construed as limited to the specific embodiments of the invention depicted and described herein, but rather is defined in the claims appended hereto.

I claim:

1. A device for opening an envelope comprising a body defining an envelope receiving slot of a predetermined width and depth, a blade having a cutting edge and reciprocally mounted relative to said body so that said cutting edge is movable to project into said slot in the direction of the width thereof, means mounted on said body for adjustably limiting the extent to which said cutting edge projects into said slot and for preventing said cutting edge from extending across the entire width of said slot including a slide having an externally manually actuable element movable in longitudinal reciprocation on the outer surface of said body and an internal element engaged with said blade, and an adjustable abutment on the external surface of said body for adjustably limiting the extent of movement of said manually actuable element.

2. A device according to claim 1 wherein said adjustable abutment is comprised of a disk mounted or adjustable rotation about an eccentric axis oriented perpendicular to the direction of longitudinal reciprocation of said slide.

3. A device according to claim 1 further comprising a return spring acting between said body and said internal element to urge said blade away from said slot.

4. A device according to claim 3 wherein said internal element of said slide includes a pair of parallel rails oriented in said direction of longitudinal reciprocation and which embrace and laterally constrain said blade, and said body includes a pair of tracks disposed parallel to said rails and said tracks laterally constrain and guide said rails in longitudinally reciprocal movement.

5. A device according to claim 1 wherein the width of said channel is no greater than about 0.5 centimeters.

6. An implement for opening envelopes comprising a body defining a cavity therewithin and forming a transverse channel of a predetermined width, a blade disposed within said cavity and having a cutting edge directed toward said transverse channel, means actuable externally of said body for effectuating relative movement between said blade and said body in longitudinal reciprocal fashion between a position in which said blade resides retracted within said cavity and a position in which said cutting edge of said blade projects longitudinally into said channel, and adjustable blade movement control means which limits the extent to which said cutting means projects into said channel to a predetermined distance which is less than the width of said channel and which is comprised of a dial eccentrically mounted upon said body, and said externally actuable means is mounted on said body for longitudinal reciprocal movement relative thereto, and said eccentrically mounted dial is located in the path of longitudinally reciprocal movement of said externally actuable means.

* * * * *